US007562607B2

(12) United States Patent
Gross

(10) Patent No.: US 7,562,607 B2
(45) Date of Patent: Jul. 21, 2009

(54) TORQUE-LIMITING TOOL

(75) Inventor: James R. Gross, Richmond, IL (US)

(73) Assignee: Teleflex Medical Incorporated, Limerick, PA (US)

( * ) Notice: Subject to any disclaimer, the term of this patent is extended or adjusted under 35 U.S.C. 154(b) by 0 days.

(21) Appl. No.: 11/700,096

(22) Filed: Jan. 31, 2007

(65) Prior Publication Data

US 2008/0178714 A1 Jul. 31, 2008

(51) Int. Cl.
*B25B 23/14* (2006.01)

(52) U.S. Cl. ..... 81/467; 81/471; 81/472; 81/473

(58) Field of Classification Search ..... 81/467, 81/471, 472, 473
See application file for complete search history.

(56) References Cited

U.S. PATENT DOCUMENTS

| | | | | |
|---|---|---|---|---|
| 2,768,547 A | | 10/1956 | Noell | |
| 3,146,811 A | | 9/1964 | Shryock | |
| 3,511,349 A | * | 5/1970 | Herscovici | 192/56.31 |
| 3,593,542 A | | 7/1971 | Urayama | |
| 4,552,042 A | * | 11/1985 | Beymer | 81/476 |
| 5,643,089 A | | 7/1997 | Hummel | |
| 6,073,522 A | * | 6/2000 | Carnesi | 81/128 |
| 6,971,284 B2 | * | 12/2005 | Owoc | 81/58.2 |
| 7,011,001 B2 | * | 3/2006 | Knox et al. | 81/467 |
| 2005/0072277 A1 | | 4/2005 | Knox et al. | |

* cited by examiner

*Primary Examiner*—Joseph J Hail, III
*Assistant Examiner*—Shantese McDonald
(74) *Attorney, Agent, or Firm*—Baker & Hostetler LLP

(57) ABSTRACT

Example embodiments of the present invention relate to a torque-limiting tool which includes a central cam having a receiver component, at least one cam holder component surrounding the central cam, propelled by a driving member or a tool handle, wherein the cam holder component includes first portions that substantially complement an external surface of the central cam and at least two second portions providing space for rotation of the cam holder component relative to the central cam, and at least one connection controlling element around the cam holder component having a bending strength to enable the cam holder component positioned to interact with the movement of the cam holder component.

18 Claims, 7 Drawing Sheets

TORQUE-LIMITING TOOL

FIELD OF THE INVENTION

The present invention generally relates to tools and fastening devices. More particularly, the present invention pertains to a device for limiting an amount of torque applied by the device.

BACKGROUND OF THE INVENTION

In various manufacturing, construction, and medical industries, fasteners are utilized that are threaded or screwed into place. These fasteners may require a predetermined amount of torque that has been determined to be optimal for a given fastening situation. In addition, the fastener may identify or stipulate a predetermined amount of torque that has been determined to fatigue or break the fastener. Often, these predetermined torque values are determined by the manufacturer or by a testing facility. In use, a technician or user may employ a device such as a torque wrench to set the fastener according to the predetermined amount of torque. In a particular example, bone screws may be employed by surgeons to reconstruct bones or attach reconstructive components to bones of patients. In such circumstances, applying a proper amount of torque may be critically important.

Conventional torque wrenches utilize forces from coil springs and spring washers along with friction to limit the amount of torque applied. Unfortunately, as components within these conventional torque wrenches slide by one another, wear may alter the torque setting of the conventional torque wrench. As such, conventional torque wrenches often need to be re-calibrated to maintain their torque limit range, typically every six months.

In a typical example, conventional torque wrenches will utilize Belleville washers, which are slightly convex or domed, and flex under pressure. The precision of the force of these Belleville washers may be limited by their dimensional tolerances and their reported spring rates, which may vary from batch to batch. Because they may exhibit a high force value over a small travel distance, the use of many washers may be required to reach a travel distance necessary for the assembly to cycle. Thus, the washers may be stacked up along a rod and pressed together with a screw plunger. In some cases, the washers are alternatively flipped, back-to-back or front-to-front. The net result is a tool that may have many small, imprecisely-aligned pieces, wherein each part may wear and flex at different rates.

In many conventional or state of the art torque tools that can be classified as "screwdriver" type tools, i.e. a handle connected to a shaft, the torque-limiting cycle may be controlled by a "one way dog clutch". This type of device is composed of two components, both aligned along a common axis. One component is stationary and the other is free to rotate about and slide along the axis. A series of radial ramps on each face align and lock the faces together. The rotation of the free component causes the two faces to alternately align and then slip over each other to the next alignment. During the rotation cycle, the faces separate by displacing a spring designed to apply a predetermined amount of torque resistance to the cam face engagement.

When the faces realign they do so rapidly with the force of the spring driving them together. This snapping together action is known to cause one or the other clutch component to split in half, thereby, breaking the clutch mechanism, additionally the spring washer stack is in constant compression and is continually pressed against a flat washer that in turn presses upon the dog clutch.

In the case of the wrench-style tool, the spring stack presses upon a plunger which, in turn, presses against one of the faces of a rotating cam. The plunger, in turn, pushes the cam into the opposing housing wall, thereby, creating the friction or resistance to rotation.

In axial handled torque-limiting tools, torque limiting occurs when the cam or clutch rotates by pushing the spring washers rearward a sufficient distance to allow rotation. The cam faces rub against each other with every rotation. When the cam rotates, the spring washers are compressed and the cam faces move apart due to the angular inclination of the ramped surfaces. Peak torque is reached when the cam faces are at their maximum separation. When the cam faces realign, they snap together into the next low torque position, and thus, no additional torque may be applied to the fastener.

A major disadvantage of conventional axial handled torque-limiting tools is that the spring washers are constantly under a compression load, even when the tool is at rest. Parts under load tend to fatigue more quickly than parts at rest; as a result, these types of tools require frequent recalibration, usually every six months. Furthermore, each snap of the cams coming together sends a shock wave down the tool shaft and into the fastener, thereby, transmitting an unnecessary force through the tool shaft to the fastener, this action, if of sufficient strength, could potentially damage the fastener.

In the conventional torque wrench type tool, a handle is attached to a tool head, which contains a hexagonal cam. In use, a tool shaft is inserted and locked into the center of the cam. The handle extending from the head contains a piston and spring washers or compression springs, which press the piston against one of the cam faces. The cam face is in turn pressed against the inner wall of the tool head. As with the axial handled torque-limiting tools, when the fastener begins to resist rotation and this resistive force exceeds the predetermined torque force of the springs, the shaft and cam may no longer be driven by the piston. Continued rotation of the handle may cause the piston to compress the springs, permitting the piston to slip over the cam peak to the next cam face. When the piston is located at the cam peak maximum torque is achieved and no further force may be applied to the fastener. With this design as well, the springs are under constant compression load leading to increased susceptibility to wear and breakage. The piston pressure causes the cam to rub and chafe against the opposite inner wall of the tool head during its rotation. Thus, heavy lubrication may be required. Also, the cam is not centered in the head and moves freely when the piston pressure is removed.

When conventional torque-limiting mechanisms fail they bind or lock-up, thereby losing the torque-limiting effect and essentially, converting the tool into a rigid, non-limiting tool, wherein the torque is regulated by the user's ability to discern torque forces by hand. This could lead to over-torqueing, which is an unsafe condition especially in the medical context.

Accordingly, it is desirable to provide a device that may be capable of overcoming at least to some extent the disadvantages of wear and breakage described herein.

SUMMARY OF THE INVENTION

The foregoing needs are met, to a great extent, by the present invention, wherein in one aspect an apparatus is disclosed providing a torque-limiting mechanism that uses a snap ring or spring coil to create a precise torque-resisting arrangement.

Example embodiments of the present invention relate to a torque-limiting tool which includes a central cam having a receiver component, at least one cam holder component surrounding the central cam, propelled by a driving member or a tool handle, wherein the cam holder component includes first portions that substantially complement an external surface of the central cam and at least two second portions providing for space for rotation of the cam holder component relative to the central cam, and at least one connection controlling element positioned to interact with the movement of the cam holder component. The central cam may exhibit a multifaceted or multi-lobed external configuration. In preferred embodiments of the present invention, the central cam may be a hex cam, cylindrical, triangular, or shaped as any polygon. Accordingly, the inner surfaces of the cam holder components may be substantially complementary in shape to the exterior shape of the central cam. The connection controlling element will be composed of a resilient, spring-like material to functionally limit the movement of the cam holder component.

The receiver component may be shaped to receive a connective end of a tool bit. In example embodiments of the present invention, the cam holder component may include a ring spreader bisected through the center of the central cam. In preferred embodiments of the present invention, bearings center the central cam in the base housing. The connection controlling element may include a snap ring or similar ring-type spring to control the torque of the tool shaft. Other example embodiments include a pivot pin about which the cam holder component pivots.

In example embodiments of the present invention, a torque-limiting tool may include a cam having a tool bit receiver, a pair of cam holder contained within a housing and driven by a tool handle, wherein the cam holder components interact with the cam, and at least one connection controlling element limiting the movement of the pair of cam holder components having a tensile strength equivalent to a predetermined torque limit and enabling the cam holder components to move into a cam expansion space.

In example embodiments of the present invention, a torque-limiting device for a tool may include a central cam element disposed about an axis of rotation and defining a receiving space for receiving a body, such as a tool bit body, a pair of cam holder components disposed around the central cam element within a housing. At least one connection controlling element may be disposed around the pair of cam holder components to bias the pair of cam holder components about the central cam element to enable rotation of the central cam element. The pair of cam holder components may be disposed within the housing to spread and rotate around the central cam element in response to an external torque applied to the central cam element by the tool shaft in response to the resistance of the fastener when said resistance exceeds a predetermined torque limit.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
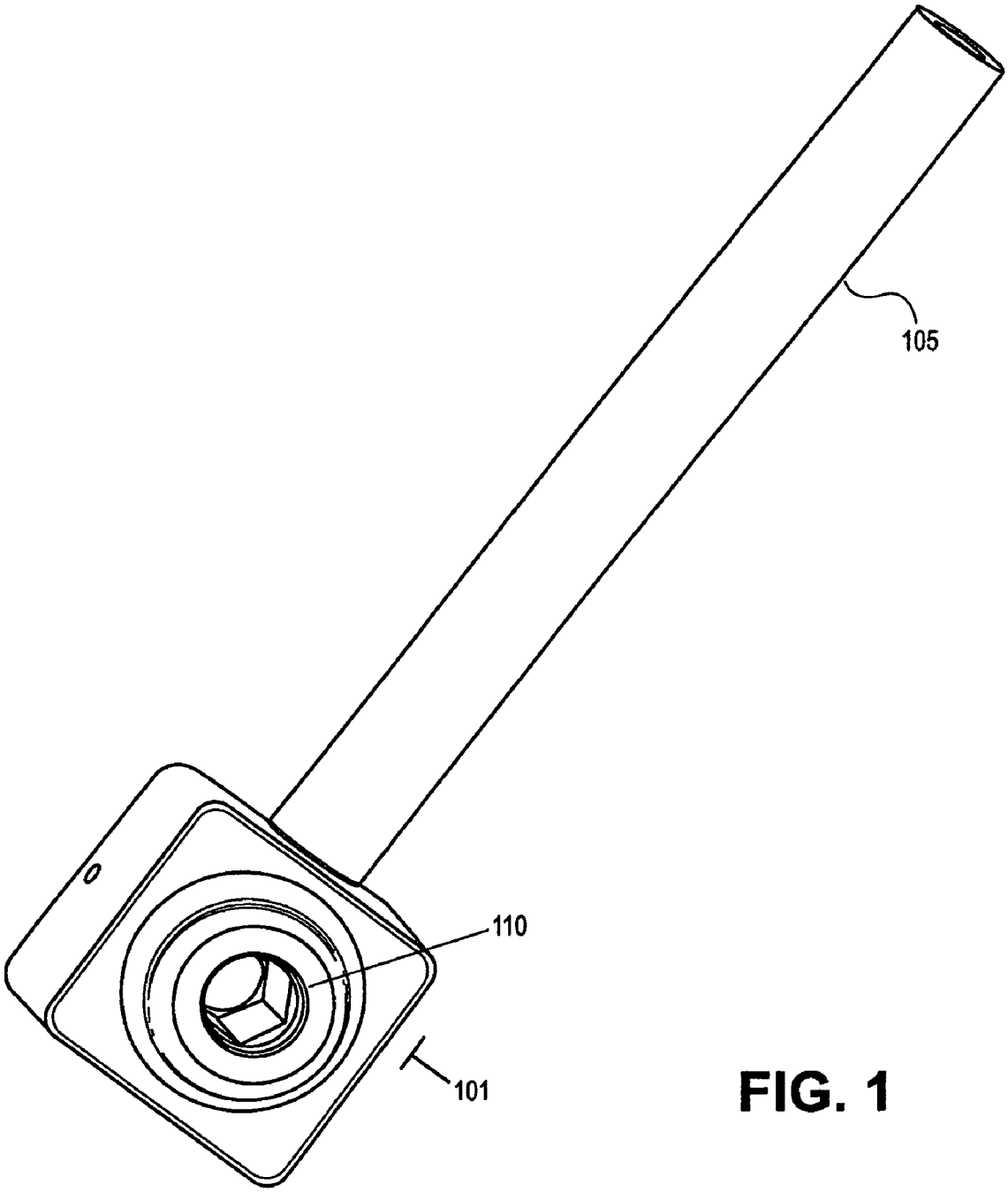
FIG. 1 is a view of the torque-limiting device with the handle, according to an embodiment of the invention.

The invention will now be described with reference to the drawing figures, in which like reference numerals refer to like parts throughout. An embodiment in accordance with the present invention provides a mechanism for limiting an amount of torque applied by a device using a torque-limiting chuck assembly. Example embodiments of the present invention include a snap ring or similar ring-type spring to control torque. Example embodiments of the present invention potentially allow for a less expensive, simpler assembly of a torque-limiting wrench having fewer parts to assemble than the conventional torque-limiting tools, which typically require many compressed spring washers. Example embodiments of the present invention provide a torque-limiting device that may be less susceptible to wear or breakage because the mechanism does not cause its components to be constantly under compression load. In one example embodiment, the torque-limiting device includes two bearings to center the cam in the wrench head.

Turning now to the figures, FIG. 1 shows a view of the torque-limiting device with the handle according to an embodiment of the invention. In example embodiments of the present invention, a torque wrench or torque-limiting chuck assembly 101 includes a receiver component or a tool bit receiver 110, which may accept and retain a tool bit (not shown) in its receiver section. The end of the tool bit conforms to the geometry of the tool bit receiver 110, which is the central cam opening. The tool bit is received therein. Typically, a spring loaded detent retains the tool bit in the cam opening 110 in a manner similar to current socket wrench products in the market today. A tool handle 105, which is the driving member, is connected to the torque-limiting chuck assembly 101 and is used to rotate the torque-limiting chuck assembly 101 and a retained tool bit (not shown) in a prescribed direction.

Figure 2:
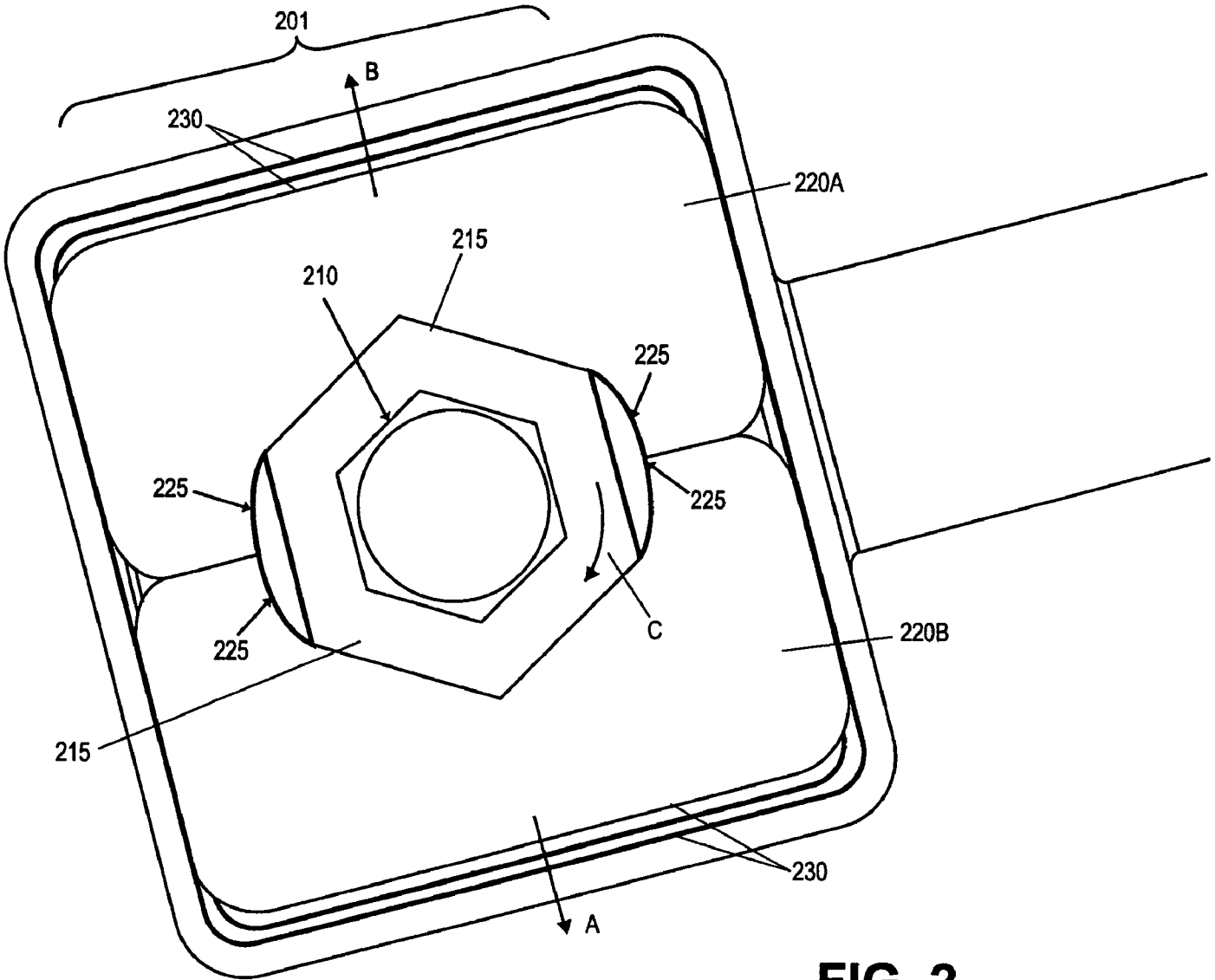
FIG. 2 is a sectional view of a split, expandable chuck assembly within the torque-limiting device of FIG. 1.

FIG. 2 is a sectional view of a split, expandable chuck assembly within the torque-limiting device of FIG. 1. In one of several example embodiments of the present invention, a central cam 215 with a hexagonal shaped external configuration and a hexagonal shaped lumen or center opening designed to be a tool bit receiver 210, is centered in the torque-limiting chuck assembly 201. The hex cam 215 describes a form with a hexagonal exterior configuration that is in mating contact with at least two ring spreading cam holders 220, individually 220A and 220B, which enclose the external sides of the hex cam 215. The inner surfaces of the cam holders 220 are substantially complementary to the outer surfaces of the hex cam 215 sufficient to retain the hex cam 215 in a holding position but are not complementary where at least two radial spaces 225 exist between the cam holders 220 and the hex cam 215. In an embodiment of the present invention, the at least two radial spaces 225 permit the hex cam 215 to rotate in the direction "C" by forcing the cam holders 220 to spread along the arrows "A" and "B", as shown in FIG. 2. The space created when the cam holders 220 are pushed apart is the cam holder expansion space 230. In a preferred embodiment of the present invention, as shown in FIG. 2, two radial spaces 225 exist between each cam holder 220 and the hex cam 215. It is understood that the cam holders 220 could function together or have a structure encompassing a single cam holder element having at least one opening point, wherein the single cam holder element would enclose the hex cam 215, disposed within the housing to disengage from the central cam 215 upon rotation of the cam holders 220 relative to the central cam element 215 in response to an external torque applied to the tool bit exceeding a predetermined torque-limit.

Figure 3:
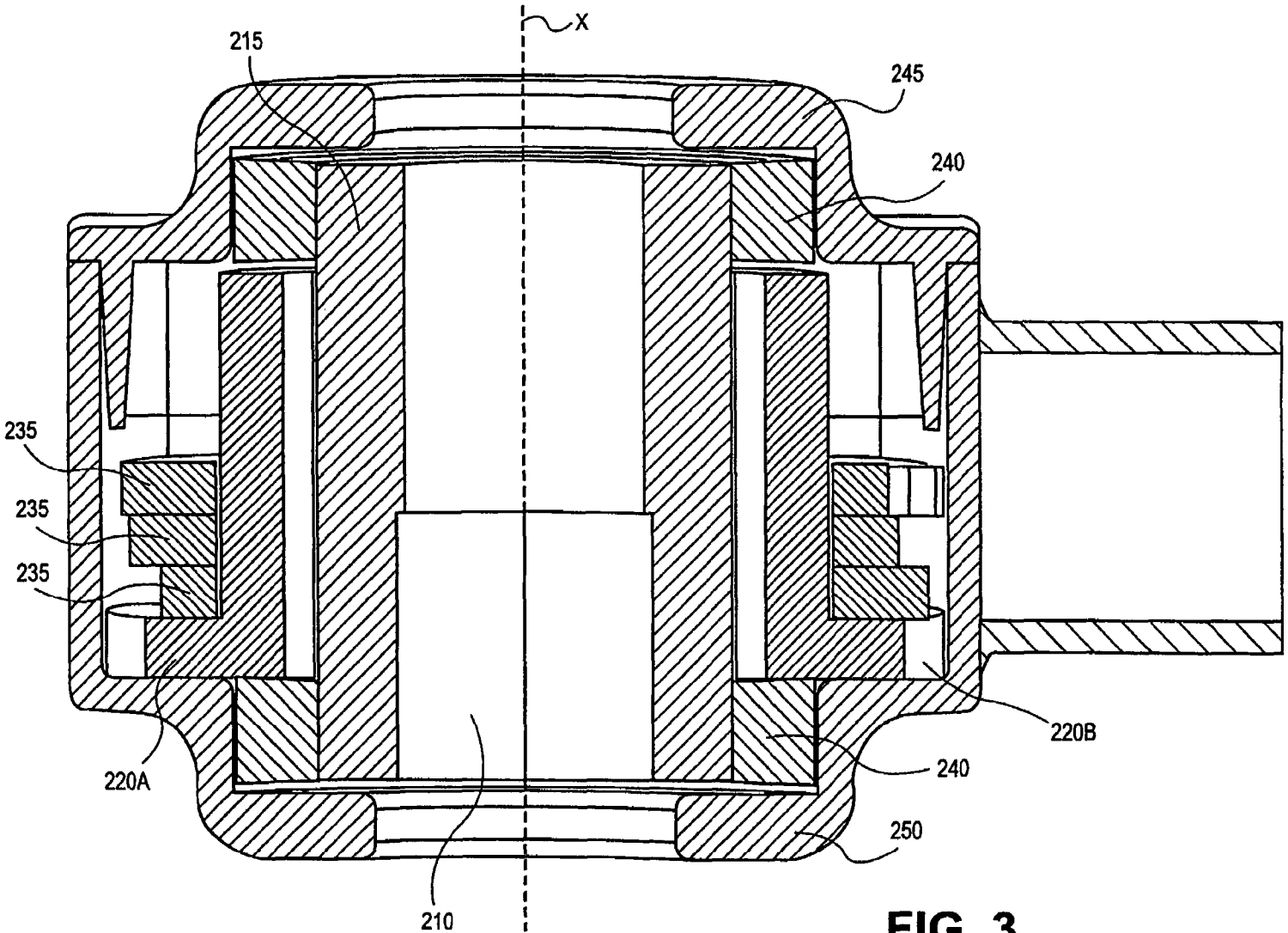
FIG. 3 is a partial sectional view of the split, expandable chuck assembly within the torque-limiting device of FIG. 1.

FIG. 3 is a partial sectional view of the split, expandable chuck assembly within the torque-limiting device of FIG. 1. In example embodiments of the present invention, at least one connection controlling element 235 holds the cam holders 220 around the hex cam 215, limiting the ability of the cam holders 220 to expand and rotate around the hex cam 215 and its central rotational axis "X". As used herein, "connection controlling element" can be a snap ring, a garter spring, or a coil spring, or similar spring-like device. In the embodiment shown in FIG. 3, they are disclosed as snap rings 235. As the torque applied at the tool bit receiver 210 increases, the hex cam 215 forces the cam holders 220 apart and stretches the snap rings 235. When this occurs, the cam holders 220 are free to expand and separate and thereby rotate around the hex cam 215. The force to open a snap ring 235, is regulated to the desired torque limit. If the external torque manifested by the fastener remains below the proscribed torque limit, the cam holders 220 will not separate. By varying the size or stiffness of snap ring 235, the applied torque may be modulated. The snap rings 235 remain unflexed or unstressed when the tool is not in use because force is exerted upon the snap rings only when the cam holders 220 expand due to an applied torque from the central cam. Bearings 240 may be used to center the hex cam 215 in the housing, which is comprised of a base 250 and a cover 245.

Figure 4:
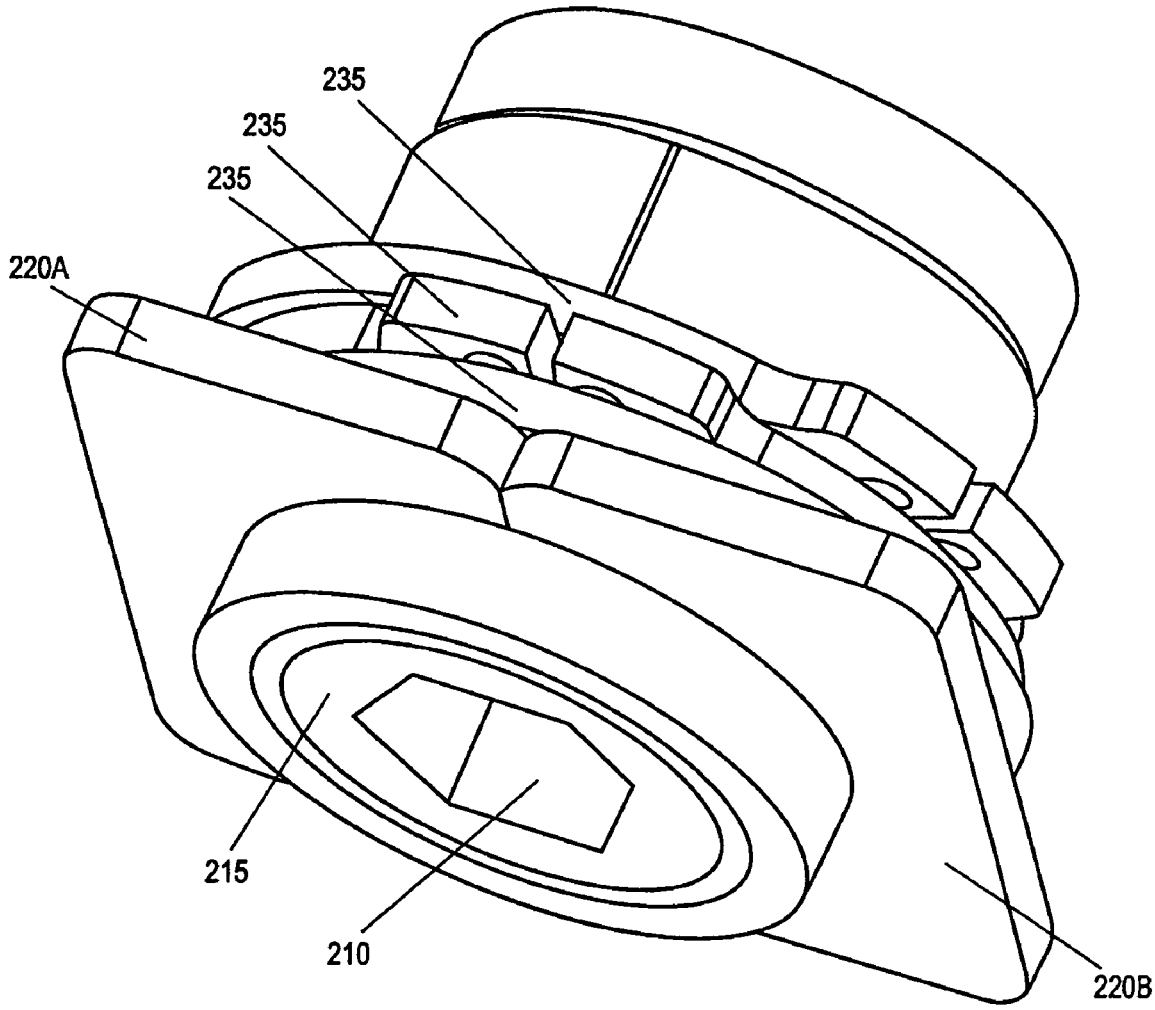
FIG. 4 is an angled side view of the split, expandable chuck assembly without the housing and handle of the torque-limiting device.

FIG. 4 is an angled side view of the split, expandable chuck assembly without the housing and handle of the torque-limiting device. A multifaceted relationship between the cam holders 220 and the hex cam 215 offers a start/stop cycle to control torque. The hex cam 215 has a tool bit receiver 210, which is a rotating member that can be coupled to a tool bit shaft. A snap ring 235 maintains a controllable connection between the chuck assembly and said tool bit shaft. The snap rings 235 rotationally couple the chuck assembly to the tool bit shaft up to a predetermined point of applied external torque. Beyond that point, the chuck assembly no longer drives the shaft. The torque-limit will be met and reset several times per handle/chuck assembly rotation depending on the number of holding engagements designed into the cam and can holder relationship. The difference in applied torque is sufficiently pronounced to clearly indicate the change to a user. Once the chuck assembly slips to the next position on the central cam the user knows that the predetermined torque limit has been reached and any further rotation will not increase the torque. The mutual configurational relationship between the cam holders 220 and the hex cam 215 must not only allow the holders to engage and drive the central cam but the relationship must also provide sufficient opening clearance to permit the cam holders 220 to rotate relative to the cam 215 when the torque limit is reached. The hex cam 215 always remains in a fixed position, relative to the fastener.

Figure 5:
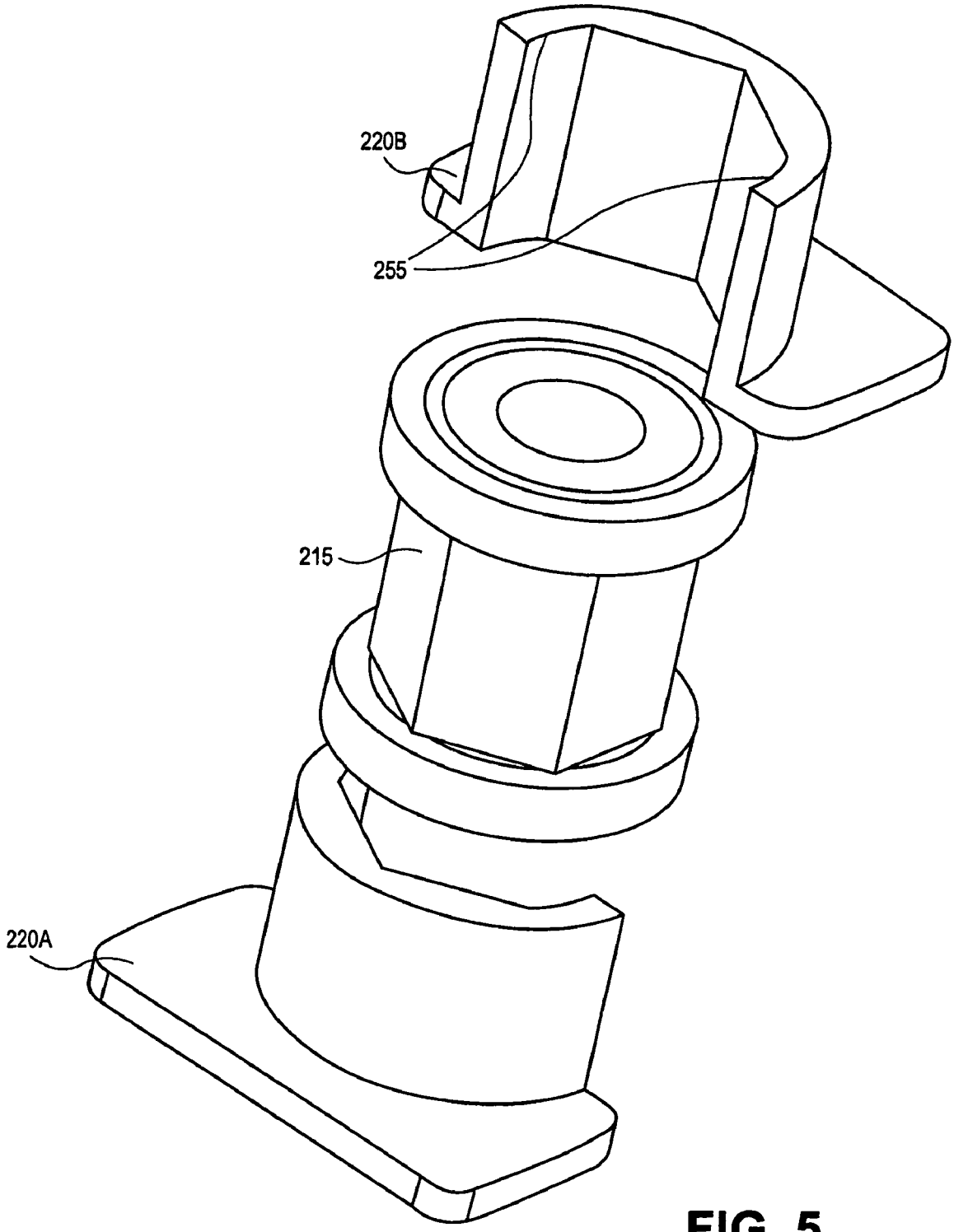
FIG. 5 is an angled side view of the split, expandable chuck assembly dismantled and without the cover and handle of the torque-limiting device.

FIG. 5 is an angled side view of the split, expandable chuck assembly dismantled and without the housing and handle of the torque-limiting device of FIG. 2. The cam holders 220 enclosing the hex cam 215 form a substantially hexagonal enclosure, formed such that four of the inner surfaces are complementary to the hexagonal portion of the hex cam and four smaller surfaces have a curved radial edge 255. The radial edge 255 allows for a radial space 225, which provides room for rotation of the cam holder(s) relative to the central cam, as discussed with regard to FIG. 2.

Figure 6:
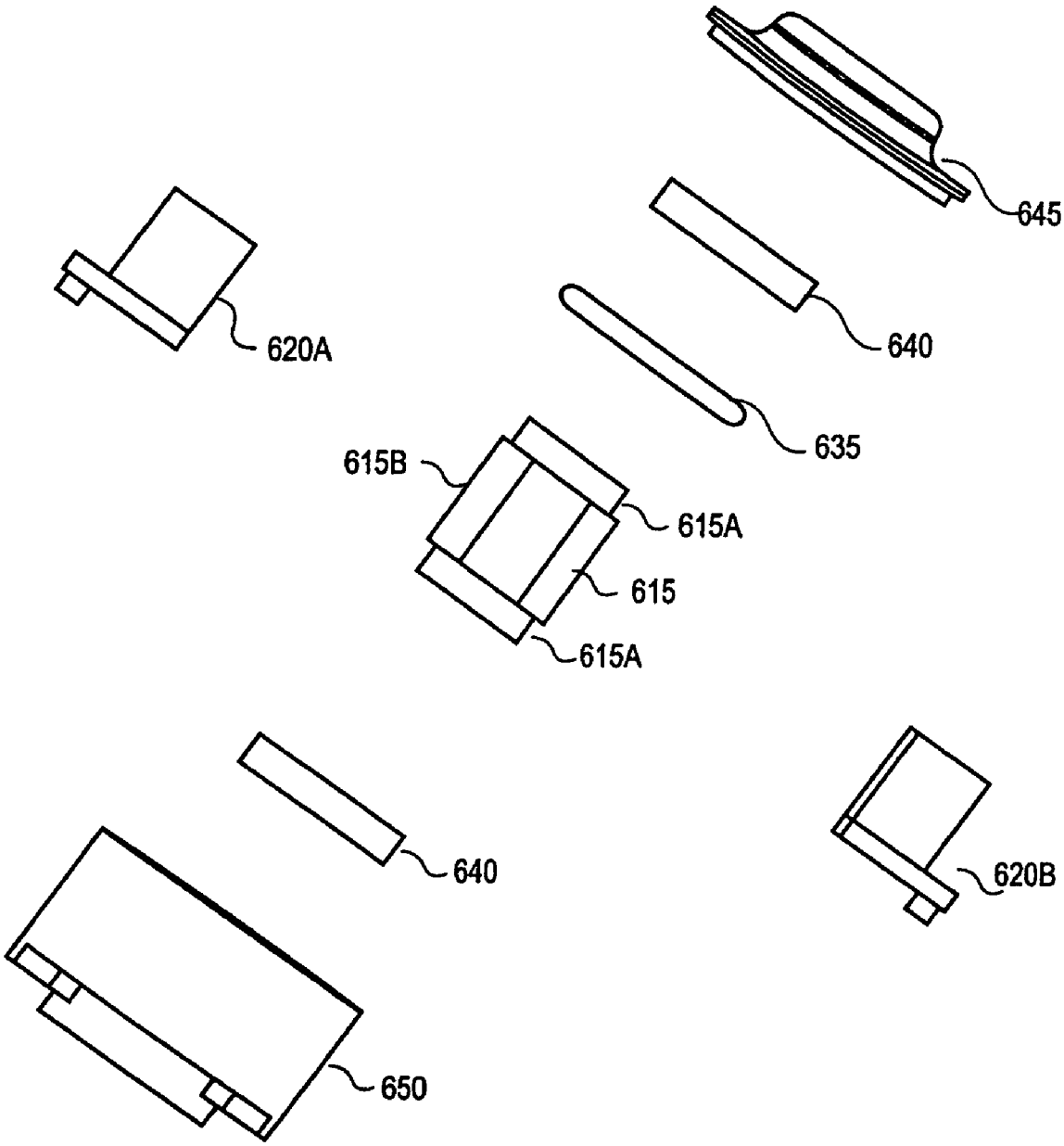
FIG. 6 is an exploded view of the individual components of a torque-limiting device, according to another embodiment of the invention.

FIG. 6 is an exploded view of the individual components of another embodiment of the torque-limiting device of the present invention. A hex cam 615 may have cylindrical portions 615A that connect to bearings 640. The hexagonal portion 615B of the hex cam 615 is enclosed by the cam holders 620, individually 620A and 620B. In example embodiments of the present invention, one snap ring 635 would surround the cam holders 620. In a preferred embodiment of the present invention, the cam holder 620 can have round exterior surfaces. Because the outer surfaces of the cam holders 620 are curved, in this example embodiment, the base 650 and cover 645 are rounded to conform to the cam holders 620.

Figure 7:
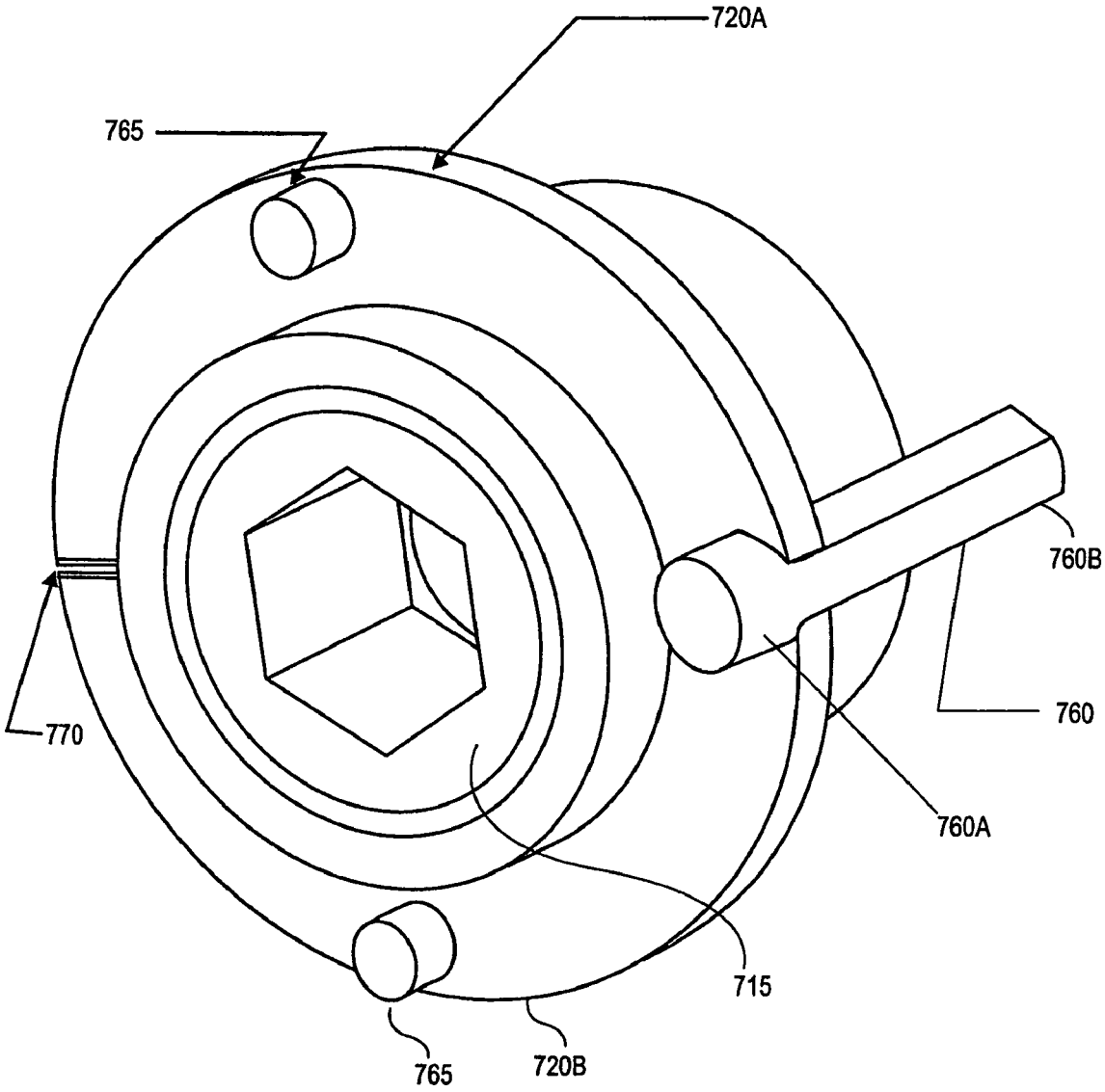
FIG. 7 is a frontal view of the tool bit receiver end of the central cam and the cam holders disposed about a pivot pin.

FIG. 7 is a frontal view of another embodiment of the present invention showing the tool bit receiver end of a split, expandable chuck, which includes a pivot pin. In an example embodiment, two cam holders 720, individually 720A and 720B, may have curved outer surfaces and inner surfaces forming a substantially hexagonal enclosure around the hex shaped cam 715. The cam holders 720 may interface at a common opening point 770 such that when the two cam holders 720 open, they each pivot around a commonly attached pivot pin 760. In a preferred embodiment, the cam holders 720 are notched, to engage the pivot pin 760. The pivot pin 760 may have a narrow portion 760B to engage a tool cover (not shown) and a cylindrical portion 760*a* to receive the cam holders and maintain the pivot pin 760 within a base. A rounded base (not shown) having a pin pocket may be used to accommodate the pivot pin 760. The rounded base additionally may have base guide slots to accommodate cam holder guide pins 765.

In other example embodiments, the cam may alternatively be a cylindrical cam surrounded by cam holders having curved surfaces where they contact the cylindrical cam so that the motion of the cam holders around the cylindrical cam is a smooth rotation and torque limiting is controlled by friction rather than geometric configuration. Accordingly, the cam holder(s) may be split with a single separation or segmented with several separations. The clamped or released distance may be very short, as small as a few thousands of an inch. The force limit attainment may only be signaled by a slight change in rotational force. Similarly, a cam having a square, triangular or even-sided polygonal shape may be substituted for the hex cam, as long as a cam holder having a complementary inner shape is used and a space for cam rotation is provided. If triangular cam and cam holders are used, the cam holder may need to be trisected at the three apexes of the triangle. In this embodiment, the clamped or released distance would be the difference between the triangle center to apex distance minus the center to base distance. A square cam may be used if the cam holder is at least bisected or quartered. An even-sided polygonal cam may be used if the cam holder is at least bisected through the center at corners of the polygonal cam.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed:

1. A torque-limiting tool, comprising:

a central cam having a receiver component, at least one cam holder component surrounding the central cam, propelled by a driving member, wherein the cam holder component includes first portions that substantially complement an external surface of the central cam and at least two second portions providing space for rotation of the cam holder component relative to the central cam;

at least one connection controlling element positioned to interact with the movement of the cam holder component, wherein the connection controlling element includes a snap ring, and;

a pivot pin around which the cam holder component pivots.

2. The torque-limiting chuck assembly, as claimed in claim 1, wherein the connection controlling element is composed of a resilient, spring-like material and the connection controlling element limits the movement of the cam holder component movement.

3. The torque-limiting chuck assembly, as claimed in claim 1, wherein the central cam exhibits a multifaceted or multilobed external configuration.

4. The torque-limiting chuck assembly, as claimed in claim 1, wherein the central cam is polygonal shaped.

5. The torque-limiting chuck assembly, as claimed in claim 4, wherein the polygonal shape is a hexagon.

6. The torque-limiting chuck assembly, as claimed in claim 1, wherein the central cam is a cylindrical cam.

7. The torque-limiting chuck assembly, as claimed in claim 1, wherein the receiver component receives a connective end of a tool bit.

8. The torque-limiting chuck assembly, as claimed in claim 1, wherein the driving member includes a tool handle.

9. The torque-limiting chuck assembly, as claimed in claim 1, further comprising a base housing and a lid.

10. The torque-limiting chuck assembly, as claimed in claim 1, further comprising:

at least one bearing having the ability to center the central cam in a housing.

11. A torque-limiting tool, comprising:

a cam having a tool bit receiver, a pair of cam holder components contained within a housing and driven by a tool handle, wherein the cam holder components interact with the cam, and;

at least one connection controlling element limiting the movement of the pair of cam holder components and having a tensile strength equivalent to a predetermined torque limit and enabling the cam holder components to move into a cam holder expansion space wherein the connection controlling element includes a snap ring.

12. The torque-limiting chuck assembly, as claimed in claim 11, further comprising a handle, base housing and a lid.

13. The torque-limiting chuck assembly, as claimed in claim 11, further comprising:

at least one bearing having the ability to center the central cam in the housing.

14. A torque-limiting device for a tool, comprising:

a central cam element disposed about an axis of rotation and defining a receiving space for receiving a body;

at least one cam holder component disposed around the central cam element within a housing;

at least one connection controlling element disposed around the at least one cam holder component to bias the at least one cam holder component about the central cam element to resist rotation of the central cam element;

at least one cam holder component being disposed within the housing to separate and rotate around the central cam element in response to an external torque applied to the tool exceeding a predetermined torque limit, wherein the connection controlling element is a snap ring biased to position the at least one cam holder component to engage an outer surface of the central cam element; and a pivot pin around which the at least one cam holder component may pivot.

15. The torque-limiting device of claim 14, wherein the central cam is a polygonal shaped element.

16. The torque-limiting device of claim 15, wherein the polygonal shaped element is hexagonal.

17. A torque-limiting tool, comprising:

a central cam having a receiver component, at least one cam holder component surrounding the central cam, propelled by a driving member, wherein the cam holder component includes first portions that substantially complement an external surface of the central cam and at least two second portions providing space for rotation of the cam holder component relative to the central cam, at least one connection controlling element positioned to interact with the movement of the cam holder component, and;

a pivot pin around which the cam holder component pivots.

18. A torque-limiting device for a tool, comprising:

a central cam element disposed about an axis of rotation and defining a receiving space for receiving a body;

at least one cam holder component disposed around the central cam element within a housing;

at least one connection controlling element disposed around the at least one cam holder component to bias the at least one cam holder component about the central cam element to resist rotation of the central cam element;

at least one cam holder component being disposed within the housing to separate and rotate around the central cam element in response to an external torque applied to the tool exceeding a predetermined torque limit; and, a pivot pin around which the at least one cam holder component may pivot.

* * * * *